United States Patent [19]

Fisher et al.

[11] Patent Number: 4,911,938

[45] Date of Patent: Mar. 27, 1990

[54] CONFORMABLE WRAP SUSCEPTOR WITH RELEASABLE SEAL FOR MICROWAVE COOKING

[75] Inventors: John R. Fisher, Hockessin, Del.; Frederick E. Simon, Lindenwold, N.J.

[73] Assignees: E. I. Du Pont de Nemours and Company, Wilmington, Del.; Campbell Soup Company, Camden, N.J.

[21] Appl. No.: 234,639

[22] Filed: Aug. 22, 1988

[51] Int. Cl.[4] ..... B65D 81/34

[52] U.S. Cl. ..... 426/107; 426/111; 426/113; 426/234; 426/243; 219/10.55 E

[58] Field of Search ..... 426/107, 111, 113, 234, 426/243; 229/125.35, 903; 219/10.55 E

[56] References Cited

U.S. PATENT DOCUMENTS

| | | | |
|---|---|---|---|
| 3,938,266 | 2/1976 | Cook | 36/19.5 |
| 4,190,757 | 2/1980 | Turpin et al. | 219/10.55 E |
| 4,210,674 | 7/1980 | Mitchell | 426/107 |
| 4,267,420 | 5/1981 | Brastad | 219/10.55 E |
| 4,404,241 | 9/1983 | Mueller et al. | 428/35 |
| 4,425,368 | 1/1984 | Watkins | 426/107 |
| 4,571,337 | 2/1986 | Cage et al. | 426/107 |
| 4,640,838 | 2/1987 | Isakson et al. | 426/107 |
| 4,656,325 | 4/1987 | Keefer | 219/10.55 E |
| 4,676,857 | 6/1987 | Scharr et al. | 156/233 |
| 4,734,288 | 3/1988 | Engstrom et al. | 426/107 |
| 4,735,513 | 4/1988 | Watkins et al. | 383/116 |

FOREIGN PATENT DOCUMENTS

| | | |
|---|---|---|
| 0063108 | 10/1982 | European Pat. Off. . |
| 0242952 | 10/1987 | European Pat. Off. . |

*Primary Examiner*—Donald E. Czaja
*Assistant Examiner*—Evan Federman

[57] ABSTRACT

A package with a preferentially releasable seal is provided, suitable for use in microwaveable food cooking. The seal includes a heat-releasable polymer in contact with a microwave susceptor material. Upon heating in a microwave oven, the seal releases in response to force generated by the cooking of the food.

19 Claims, 7 Drawing Sheets

CONFORMABLE WRAP SUSCEPTOR WITH RELEASABLE SEAL FOR MICROWAVE COOKING

BACKGROUND OF THE INVENTION

This invention relates to packaging materials useful for microwave cooking applications, and particularly to packaging material which will brown and crispen food items and which provide a selectively releasable seal around such food items.

There has been much interest recently in packaging materials which aid in browning and crispening of food items in a microwave oven. U.S. Pat. No. 4,267,420, to Brastad, discloses a food item wrapped with plastic film having a very thin coating thereon. The film conforms to a substantial portion of the food item. The coating converts some of the microwave energy into heat which is transmitted directly to the surface portion of the food so that a browning and/or crispening is achieved.

U.S. Pat. No. 4,676,857, to Scharr, discloses a microwave heating material and method for its preparation. A preselected metallized pattern, such as dots, spirals, or circles, is disposed on at least a portion of a dielectric material. The dielectric material may be in the form of a flexible wrap.

Other inventions have used the fact that various polymeric materials lose strength at elevated temperatures to perform useful packaging functions. U.S. Pat. No. 4,404,241, to Mueller et al., discloses a microwave package with a means for venting vapor. The vent is in the form of an aperture in the multilayer sheet which forms the package, and is covered with a continuous sealing layer of an extrudable hot melt material. When this material is subjected to slight pressure in combination with heat, softening and flow occurs at temperatures effective to permit venting of steam or other vapor without sufficient pressure build-up to distort the package.

U.S. Pat. No. 4,561,337, to Cage et al, discloses a bag and a mixture of edible popcorn ingredients suitable for use in microwave ovens. Portions of the panels of the bag contain a coating that is sensitive to pressure and heat, forming a seal along the top edge of the panels. The seal has sufficient strength to withstand the internal steam pressure generated by the moisture content of the kernels for at least one-half of the popping process. Preferably, the bag will vent at the top seam before the process is completed to allow steam to escape.

In spite of significant efforts in formulating packaging materials suitable for microwave cooking applications, there remain foods which are difficult or impossible to prepare in a microwave oven. Examples include "puff pastries" such as filled turnovers, which must both rise and be browned during cooking. When such foods are cooked in a microwave oven, they may fail to rise or may rise only irregularly, and may not brown. The packages in the prior art are not designed to allow such foods to rise. They generally require close contact between the food and the microwave susceptive packaging material, and thus constrain the food. If a gap were to be left between the food and the film, large enough to permit the food to expand, there would then not be sufficient heat transfer between the film and the food for proper cooking or browning.

The present invention, in contrast, provides packages for use in microwave ovens which allow the proper browning and shaping of foods which rise upon cooking. The present invention further provides packages which allow proper browning of foods as well as venting of the steam or vapor generated from cooking.

SUMMARY OF THE INVENTION

The present invention provides a package useful for cooking food in a microwave oven, comprising;

(a) a thermally stable film wrapped about said food;

(b) at least one layer of heat releasable thermoplastic material located on at least a portion of the surface of said thermally stable film and forming a seal between at least two surface areas of said thermally stable film, whereby the film is sealed in its wrapped conformation; and (c) a microwave susceptor material in close proximity to at least a part of said seal, whereby said seal is selectively releasable upon exposure to microwave energy and resultant heating of the microwave susceptor material under microwave cooking conditions.

The present invention further provides a process for preparing a package for cooking food in a microwave oven, comprising the steps of:

(a) selecting a conformable film having coated thereon at least one surface layer of a heat-releasable thermoplastic material and a microwave susceptive material in close proximity to said heat-releasable thermoplastic material, said conformable film being of sufficient size to contain said food when said film is folded over on itself, (b) folding said conformable film over on itself to form two flaps, with the side of said film coated with the surface layer of heat-releasable thermoplastic material facing inward, (c) placing said food between said flaps, and (d) sealing the film around the remaining edges of said food to form at least one seal in which said microwave susceptive material is in close contact with the heat-releasable thermoplastic material forming the seal, whereby the food is securely enclosed within said film.

The invention also provides a process for cooking foods in a microwave oven, comprising placing food contained in the package of claim 1 into a microwave oven and operating said oven for a time sufficient to cook said food.

DETAILED DESCRIPTION OF THE INVENTION

The foods which may be prepared by using the packages of the present invention are foods which require browning and crispening of their surfaces during cooking. These foods include french fries and other forms of fried potatoes, fried chicken, egg rolls, and the like. Foods which are particularly suited for this invention are those foods which in addition to browning and crispening are also required to rise during their cooking. Examples of such foods are "puff pastry" items. Most especially suited to the use of this invention are turnovers. These foods employ "puff paste," prepared from approximately equal parts of flour and shortening, usually butter, rolled and rerolled, and folded after each addition of butter. The pastry is designed to rise into leaves and flakes upon cooking, expanding to several times its original, uncooked, volume. The filling of these pastries may be any of a variety of foods, although fruit or vegetable fillings are commonly used. A fruit filling may consist of fruit and optionally syrups, sugar, spices, and the like, to enhance flavor.

Figure 1:
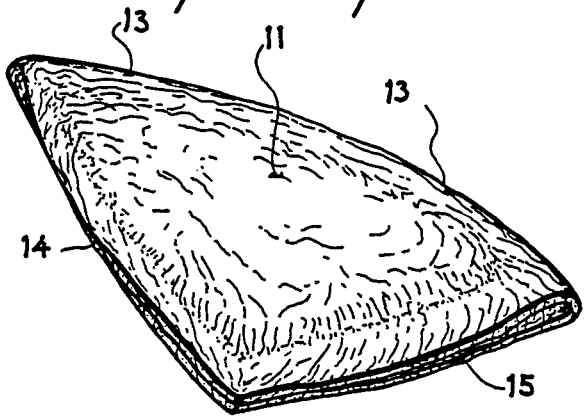
FIG. 1 is a perspective view of a filled puff pastry food, shown in the uncooked, frozen state.
Figure 2:
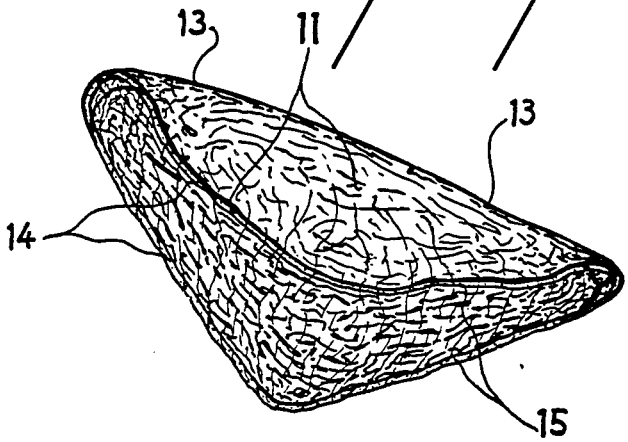
FIG. 2 is a perspective view of the pastry of FIG. 1, in its expanded state after cooking.

FIG. 1 shows a turnover 11 that has been formed by folding a square of uncooked pastry diagonally over the filling along fold 13, to form a triangle. The pastry is crimp sealed along edges 14 and 15, and is normally packaged and frozen before sale. FIG. 2 shows turnover 11 after cooking. The turnover has expanded, and edges 14 and 15 have risen to as much as ten times their original frozen height.

Figure 3:
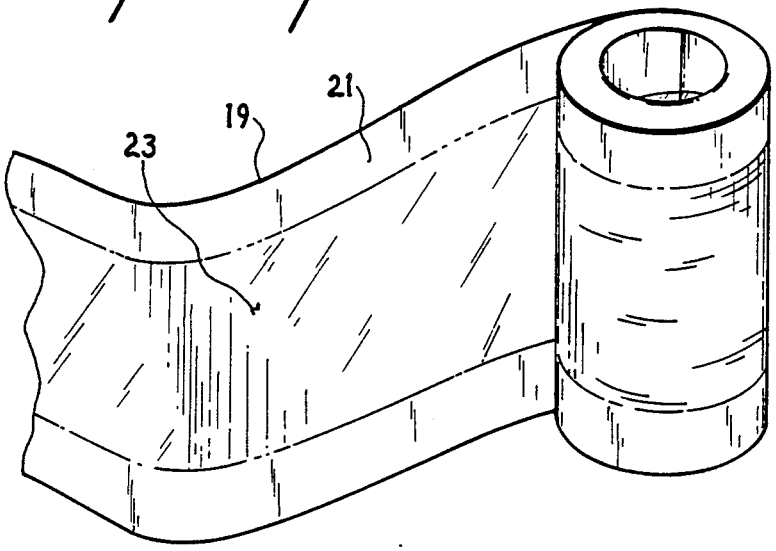
FIG. 3 shows a roll of susceptor film.

The package of the present invention is prepared from conformable microwave susceptor film. Such film is described in detail in copending U.S. patent application Ser. No. 002,980, the disclosure of which is incorporated herein by reference. An example of such microwave susceptor film is shown in FIG. 3, partially unwound from a roll. The film is a multiple layer structure, comprising a base film 19 of a thermally stable polymer. By the term "thermally stable" is meant a material which maintains its structural and dimensional integrity at cooking temperatures for expected cooking times. Such a thermally stable film should withstand temperatures of at least 200° C. for ten minutes or more. One such material is polyethylene terephthalate, which has a melting point in the range of 250°-260° C. Other suitable films include those made from polyesters, polymethylpentene, polyarylates, polyamides, polyimides, polycarbonates, or cellophane.

One surface 21 of the film in FIG. 3 is coated with at least one layer of a heat-releasable thermoplastic polymer (not visible in the figure). By the term "heat-releasable" is meant a material which melts or otherwise loses sealing strength at a temperature above ambient. Typically such a polymer is also heat sealable. Thus a seal can be made by heating the material above a certain temperature, and applying a suitable force to hold the surfaces to be sealed, until a seal is formed. Similarly, such a seal, when reheated above this temperature, loses strength and may be opened. A number of such heat-releasable, thermoplastic polymers are known, including ethylene copolymers such as ethylene vinyl acetate copolymers, polyvinylidene chloride, and thermoplastic copolyesters having melting points of about 50° C. to 200° C. Some such thermoplastic polymers are listed in copending U.S. patent application Ser. No. 002,980; however, that application also lists several thermosetting, curing, or crosslinkable polymers, which are not suitable for the present invention. Examples of preferred heat-releasable polymers include polyester copolymers selected from the group consisting of copolymers of ethylene glycol, terephthalic acid and azelaic acid; copolymers of ethylene glycol, terephthalic acid, and isophthalic acid; copolyesters prepared from the condensation of terephthalic acid or 2,6-naphthalenedicarboxylic acid, with ethylene glycol, butylene glycol, or 1,4-cyclohexanedimethanol; or mixtures of these copolymers. Preferably the heat-releasable polymer is a copolyester prepared by the condensation of ethylene glycol and about equal parts of terephthalic and azelaic acids; terephthalic and azelaic acids in the mole ratios of about 50:50 to about 55:45 are preferred. Customary amounts of other materials, such as processing aids, antioxidants, fillers, etc., may also be present in the heat-releasable thermoplastic material.

The heat-releasable polymer should preferably have a peel strength of at least about 38 N/m (100 g/inch) at room temperature and a much lower peel strength at elevated temperatures. Samples for a measurement of peel strength can be prepared by heat sealing two films at 120° C. for about ¼ second at 34 kPa (5 psig), using the heat-releasable polymer as the seal. The amount of heat releasable polymer on each film is about 2-3 g/m$^2$. The peel strength can be measured with a Model 1120 Instron, using a Thomas M. Rhodes atmosphere control chamber for temperature control. The peel strength of such samples is relatively independent of the presence or absence of susceptor flake. The typical peel strength of a seal prepared from a copolymer of ethylene glycol, terephthalic acid, and azelaic acid, as described above, is shown below.

| Temp. (°C.) | Strength (N/m) |
|---|---|
| 23 | 86 |
| 60 | 42 |
| 100 | 21 |
| 150 | 5 |
| 200 | 0.4 |

The peel strength, is, of course, related to the yield temperature of the sealing polymer. Seals having different, predetermined release temperatures, and thus different strength versus temperature profiles, can readily be prepared by blending polymers of appropriate yield temperatures. Other polymers suitable for blending include polyester copolymers prepared by condensing ethylene glycol with terephthalic and isophthalic acids in the ratios of about 50:50 to about 60:40.

Microwave susceptor material can preferably be applied to the entire surface 21 of the film, or more preferably in the form of a centrally located optically opaque stripe 23 (FIG. 3.) The susceptor material preferably comprises a coating of (i) about 5 to 80% by weight of metal or metal alloy susceptor in flake form, embedded in (ii) about 95 to 20% by weight of a heat-releasable thermoplastic dielectric material. More preferably the relative amount of susceptor will be about 25 to 80% by weight, and most preferably about 30 to 60% by weight. The heat-releasable thermoplastic dielectric material may be the same material as the heat-releasable polymer described above: The thickness of the coating which forms the central stripe, the concentration of susceptor flakes therein, and the microwave absorption properties of the susceptor flakes should be sufficient to heat the heat-releasable thermoplastic material to above its yield temperature, and should also be sufficient to provide enough heat to brown and crispen the surface of an adjacent food item, when exposed to the microwave energy of an oven. The coating, of course, should not contain too high a concentration of susceptor flake. In such a situation so much heat may be generated that the plastic sheet or the food is damaged. The appropriate parameters are readily determined by one skilled in the art. We have found coating thicknesses of about 0.01 mm to about 0.25 mm (about 0.4 to 10 mils) to be suitable for many applications. The surface weight of the susceptor coating on the substrate is from about 2.5 to 100 $g/m^2$, preferably about 10 to about 85 $g/m^2$.

Suitable susceptor flake materials for use in the susceptor layer include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10, and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 1:2. Alternatively, the flakes, if not circular, can be applied to the film in two or more separate passes, which also provides an improvement in the degree of uniformity of heating. Films prepared from such material will typically have a surface resistance of at least $1\times10^6$ ohms per square, and are normally optically opaque.

Films supporting other sorts of microwave susceptor materials need not be optically opaque. The use of the term "opaque" is not meant to exclude other suitable materials. For example, the present invention is not limited to films which have this type of flake coating as the microwave susceptor material. Certain films prepared by metal coating, such as by vacuum or sputter metallizing, or by other means, may also be suitable, but only if they exhibit the desired properties of heat generation and dissipation. For example, a combination of a seal prepared from a thin layer of film, with low thermal mass, and a susceptor coating which generates a great deal of heat can result in melting or burning of the sealing surfaces and destruction of the seal before the food expands or cooks. Clearly, there must be a balance between heat generation, heat dissipation, thermal mass of film and food (which acts as a heat sink), and cooking requirements of the food item. Such a balance can be readily determined by the person of skill in the art. The preferred films, incorporating flake susceptor as described herein, are particularly suited for preparing packages which have this desirable balance of properties.

Figure 4:
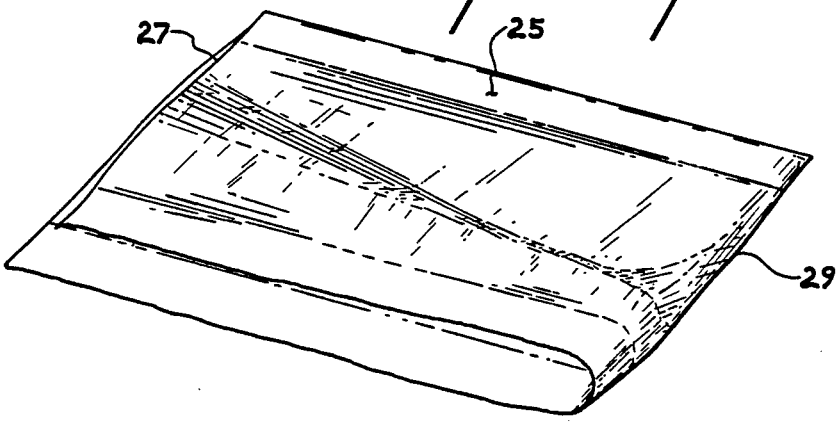
FIG. 4 is a view of a partially formed pouch made from the film of FIG. 3.
Figure 5:
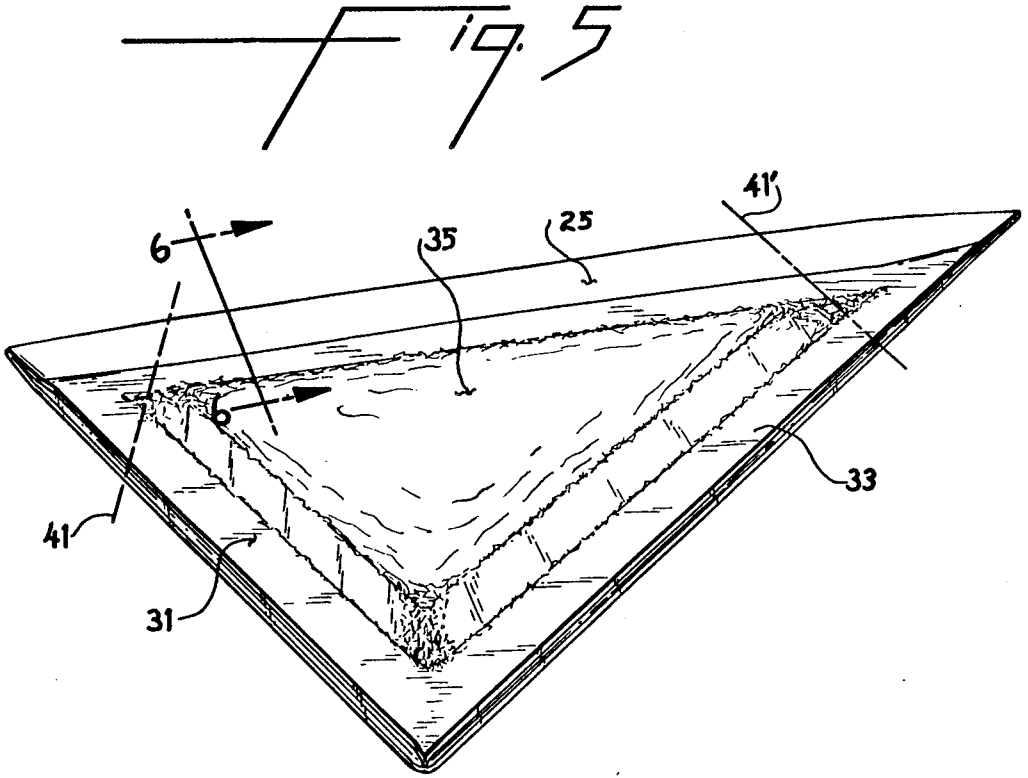
FIG. 5 is a perspective view of a fully formed pouch containing a puff pastry food (not visible).

There are many possible ways to prepare the package of this invention, and many different geometries are possible. The susceptor material, for example, may be limited to those areas of film from which selectively heat-releasable seals are formed, but preferably the susceptor material extends over at least the portion of the film which is to be wrapped about the food. The preparation of such a preferred package is shown in FIGS. 4 and 5. In this package, for use with a turnover, the length of the film which is used should be about twice the length of edge 13 of food item 11, plus enough material to form a seal. For packaging of a triangular turnover a strip of film with the sealable face 21 facing inward is folded over lengthwise as shown in FIG. 4. A seal 25 is formed along one of the transparent borders. This sealing may be done using an iron sufficiently hot to cause the adjacent surfaces coated with sealable, heat-releasable polymer to seal together. The seal may also be formed in part from opaque, susceptor laden portions of the film adjacent to the transparent border, as shown in FIG. 5. Thus a partial pouch 27 is formed, closed on two adjoining sides by seal 25 and fold 29.

The pastry item is centrally placed in the partial pouch, with edge 13 adjacent to seal 25. A hot iron is used to completely seal partial pouch 27 snugly along edges 14 and 15 of item 11, to form seals 31 and 33, as shown in FIG. 5. Thus the film is sealed to itself in conformity about the food item. In this figure the fully sealed package is shown having seals 31 and 33 optionally trimmed to form a generally triangular package. Of course, alternative means of folding the film can be used which may not require trimming in order to obtain a triangular package. Furthermore, the film need not be sealed snugly about the food. But if the food is only loosely confined, it may not brown as uniformly as desired, and the advantages of the selective releasability of the seal may be less pronounced.

For cooking of certain foods it is important that the package of the present invention contain one or more vents. The presence of vents permits the escape of steam or vapor generated by cooking, and prevents the food from becoming soggy. The specific requirements for venting will vary with the food being cooked. For cooking of pastry as described above, it is desirable that one or more corners of the package be cut open, along lines 41 and 41' in FIG. 5, for example, to form vents before cooking is begun.

In order to cook a food item in the package of this invention, the package is placed in a microwave oven and heated for a time sufficient to cause the food to be suitably browned and, if desired, raised. In this regard, it has been found helpful in some instances to locate the package during the cooking time on an inverted paper plate or other such object resting on the bottom of the oven. Elevation of the package about 2.5 to 3 cm above the oven floor in this way often causes the film at the bottom of the food to be heated to a higher temperature than that at the top of the food and may lead to more satisfactory cooking. The actual spacing, as well as the preferred cooking time, may vary with the particular food item and oven used, but can be readily determined.

The important characteristic of the present invention is the fact that the polymer used for the seal loses peel strength when it is heated. Any seals which include one or more layers of a heat-releasable polymer in close proximity to microwave susceptor material will progressively weaken and then release when the film continues to heat by the microwaves. The term "close proximity" is intended to mean sufficient contact or proximity between the susceptor material and the heat-releasable polymer such that the heat generated from the susceptor material is transferred to the heat-releasable polymer. In this way the polymer is heated sufficiently to cause the seal to loosen during cooking. Such close proximity may arise, for example, from having a layer of susceptor material overlying a layer of heat-releasable polymer. Alternatively, the susceptor material, in the form of flakes, may be embedded and contained within the layer of heat-releasable polymer which forms the seal itself. Since the susceptor material can produce a film temperature of at least about 150° C. within one minute when subjected to the microwaves of a 700 W oven, the peel strength of the heat-releasable polymer in close proximity to the susceptor material is reduced, and seals formed therefrom release in a gradual, controlled, and reproducible manner.

The gradual release of the seals of this invention allows for the controlled expansion of the pastry. The pastry expands fully while it is being browned and crispened by the heat from the susceptor film, which remains conformed to the surface of the food. The geometry of the package and of the seals can be adjusted in order to permit the food item to expand in a desired, controlled, manner upon cooking.

In the package described above and shown in FIG. 5, the seals 31 and 33 located at the edges of the pastry where the greatest expansion occurs (edges 14 and 15) are the ones which heat, release, and allow for fullest expansion during heating. These seals contain the susceptor material throughout the extent of the seal, and open in response to the expansion of the food item. The material sealed together by portions of the film without susceptor flakes, such as part of seal 25, on the other hand, will not heat significantly during microwave cooking. Such transparent seals release with more difficulty or not at all.

Figure 6:
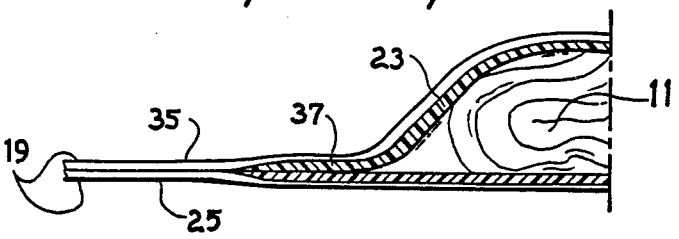
FIG. 6 shows a cross section of one of the edge seals of the pouch of FIG. 5.
Figure 7:
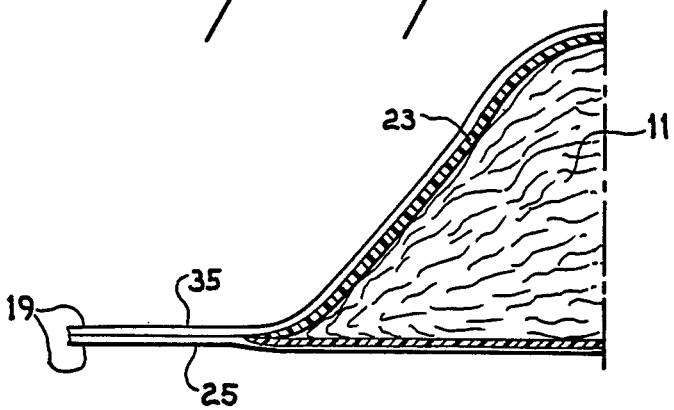
FIG. 7 shows a cross section of the seal of FIG. 6 after cooking and expansion of the food.

In this way, limited amounts of expansion along a seal such as 25 can be realized by providing susceptor material in close contact with that part of the seal that must give way. This situation is illustrated in FIGS. 6 and 7, which are sectional views taken along line 6—6 of FIG. 5, before and after cooking, respectively. FIG. 6 shows the pastry 11 sealed between the two layers of film 19. The seal 25 consists of two parts, an optically clear seal portion 35 near the edge, and an optically opaque part 37 which includes the susceptor coating layer 23. Upon heating, the opaque portion peels open under influence of both the temperature and the pressure exerted by the expanding pastry. When the nonsusceptive clear portion 35 is reached, peeling ceases, and expansion of the pastry at the seal stops. The expanded package is shown in FIG. 7, which shows how the pouch has expanded by release of the seal to accommodate the rising of the pastry. As the seal progressively opens, the pastry is exposed to additional area of susceptor material, which assures adequate browning along its edge.

Figure 8:
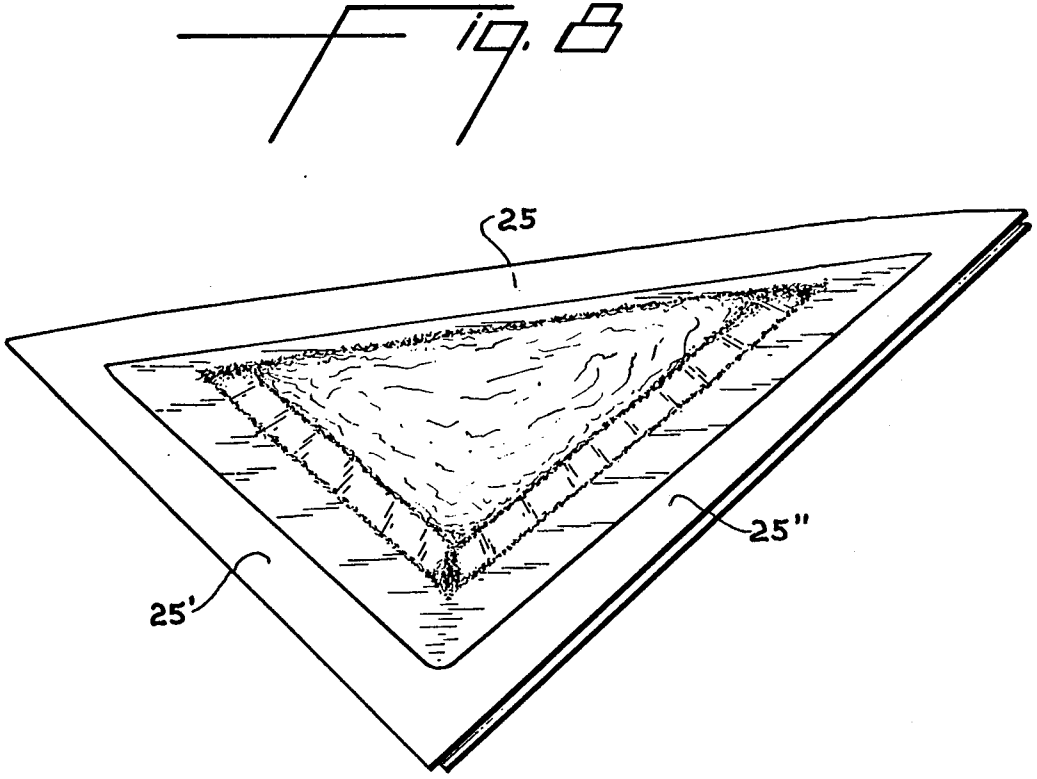
FIG. 8 shows an alternative embodiment of the package of the present invention.
Figure 9:
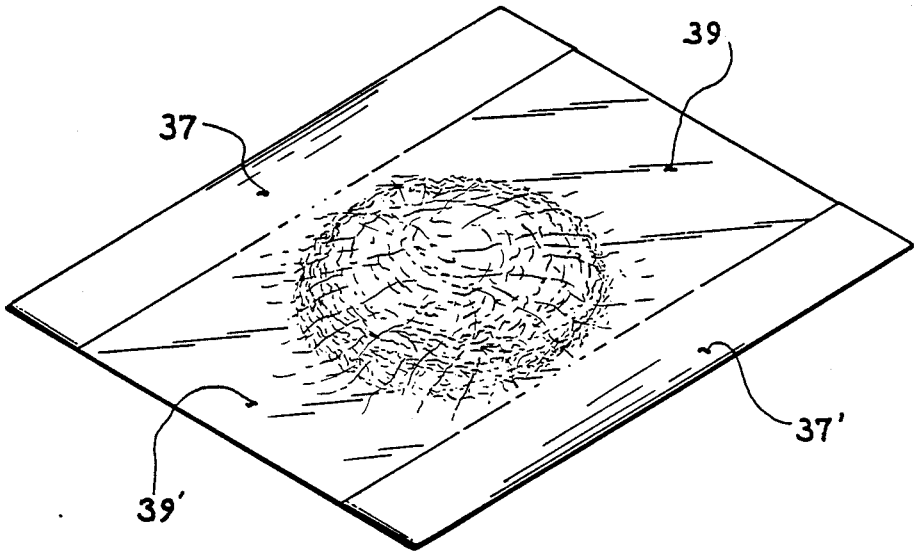
FIG. 9 shows another alternative embodiment of the present invention.

It may be desirable under some circumstances to make all seals partially releasable. Such an arrangement is shown in FIG. 8, with partially releasable seals 25, 25', and 25''. But it is more often desirable that at least one, and preferably two seals be completely releasable. In a case where constraint or shaping of the food is not critical, the seals can be completely opened during the cooking process in the regions of the pastry which expand the most. In this way the package is completely open at these seams after cooking and the food can be easily removed and served. Other patterns, shapes, and modes of package and seal formation are of course possible to accommodate the requirements of various foods and are included within the scope of this invention. FIG. 9 shows such a package in a rectangular shape, with partially releasable seals 37 and 37' and completely releasable seals 39 and 39'.

The present invention is also useful for other foods, such as french fries, which do not rise upon cooking. In cooking such foods it is often desirable to have a package which is self-venting. Thus the steam or vapor generated from the cooking process may exert enough pressure that the selectively releasable seal opens sufficiently to permit venting. The release of this vapor aids in the browning and crispening of surfaces of the food.

Containers including the selectively releasable seal of the present invention are not even limited to the uses mentioned above. They are broadly applicable to other applications in which a seal is desired which becomes releasable in response to microwave energy. Such other applications include popcorn bags and the like.

COMPARATIVE EXAMPLE 1

A conventional oven is heated to about 245° C. A frozen apple turnover prepared with puff pastry and uncooked apple filling (from Pepperidge Farm, Inc., Norwalk, Conn. 06856) is placed on an ungreased baking sheet and is baked at about 200° C. for about twenty minutes. During this time the pastry cooks, and the dough puffs into leaves and flakes and attains a golden brown color. After cooking, the pastry is removed from the oven and placed on a wire rack to allow the interior to cool for about 20 minutes. Total preparation time from freezer to serving is about forty minutes.

EXAMPLE 1

A microwave susceptor sheet is prepared by selecting a sheet of biaxially oriented PET coated on one side by a heat-releasable copolymer composition. The heat-releasable copolymer is prepared by the condensation of 1.0 mol ethylene glycol with 0.53 mol terephthalic acid and 0.47 mol azelaic acid. This copolymer (15.8 parts by weight) is combined with 0.5 weight parts erucamide and 58 weight parts tetrahydrofuran. After dissolution of the solids at 55° C., 0.5 parts by weight of magnesium silicate and 25 parts by weight of toluene are blended in, and this mixture is coated onto the PET sheet and dried. The sheet so prepared is designated "Sheet 1." The thickness of Sheet 1 is about 0.025 mm (1 mil) after coating. To the uncoated side of Sheet 1 is applied, in three passes, a mixture of 50% by weight of dry aluminum flake in a heat-releasable copolymer composition as described above, the mixture being suspended in tetrahydrofuran. The aluminum flake is "Silberline" 3641, 325 mesh grade, the flakes being about 32 micrometers in diameter. After evaporation of the tetrahydrofuran, the resulting film has a total dry coating weight of about 30 $g/m^2$ and a surface concentration of aluminum of about 12–15 $g/m^2$. The thickness of the layer containing the aluminum flake is about 0.03 mm (1.1 mils), and the total thickness of the coated sheet is about 0.05 mm (2.1 mils). A strip of this susceptor material about 10 cm (4 inches) wide is cut. The strip of film thus prepared is designated as "Sheet 2." A second strip of the material of Sheet 1, about 15 cm wide, is selected (referred to as "Sheet 3"). Sheet 2 and Sheet 3 are put together such that the layer of aluminum flake-containing polymer on Sheet 2 is adjacent to the copolymer layer of Sheet 3. A layer of adhesive ("Adcote ®" cross linkable copolyester, from Morton Chemical) is used to secure the sheets to form a composite sheet. The composite sheet thus prepared consists of a sheet with an optically opaque coated central portion, much like that shown in FIG. 3.

A piece of this composite sheet about 33 cm long is folded lengthwise, coated side inward, and the transparent strip along one edge is sealed to itself to form an open pouch. A strip about 2 cm wide of opaque material adjacent and parallel to the transparent strip is also sealed to itself. The sealing is done by using a hot (about 120° C.) sealing iron for about 0.25 to 1 second.

A frozen turnover prepared with puff pastry and uncooked apple filling as in Comparative Example 1 is placed into the open pouch formed from the susceptor film. The long folded edge of the turnover is placed against the seal. The pouch is sealed around the remainder of the turnover by using the hot iron, as above, to seal the susceptor material to itself along the two short crimped edges of the turnover. The package is trimmed to make a neat triangular shape, with borders about 2 cm wide surrounding the pastry. The two corners of the film nearest the folded edge of the turnover are cut off to provide vents.

The entire package containing the frozen turnover is placed on an inverted 25 mm (1 inch) paper plate on the bottom of a 700 watt TM Sharp" microwave oven and cooked for four minutes at full power. During the cooking period the seal progressively opens from the inside outward to accommodate expansion of the pastry. The seal slowly peels back, and the film-food contact is maintained.

At the end of the cooking time the turnover is removed from the oven. The opaque seals along the short sides of the package have opened almost completely. The turnover itself has expanded to several times its original thickness, rising to a height of about 5 cm. The turnover is browned, crispened, and flaky, very similar to one cooked in a conventional oven. The fruit center is also properly cooked.

COMPARATIVE EXAMPLE 2

An apple turnover as in Comparative Example 1 is cooked in the same microwave oven, but without the susceptor film. After four minutes, the turnover is pale in color and has risen only partially and in an irregular manner.

COMPARATIVE EXAMPLE 3

An apple turnover as in Comparative Example 1 is laid on a piece of the film of Example 1. The film is folded across the top of the turnover, without sealing it. Upon cooking in the same microwave oven as in Example 1, the turnover expands in an uncontrolled fashion, yielding a broken product with filling which exudes from the interior, and assuming a final shape that is not attractive. It is thus clear that the controlled release of the seals of the present invention provides a controlled, constraining force on the pastry, and results in a superior product.

COMPARATIVE EXAMPLE 4

An apple turnover as in Example 1 is sealed in a film with no susceptor material ("Sheet 1" from Example 1). It is cooked for four minutes in the same microwave oven as in Example 1. The turnover expands in a controlled manner, the clear seams yielding somewhat but not opening. The cooked turnover has a fairly good shape but is not browned.

EXAMPLE 2

A frozen puff pastry ("Vegetable In Pastry TM" from Pepperidge Farm, Inc.) containing a filling of broccoli and cheese, is placed in a partially formed pouch as in Example 1. Since this vegetable pastry is in a hexagonal shape, it is placed near the center of the strip and sealed around all edges using the technique of Example 1. The package thus formed resembles that of FIG. 9.

The package is cooked in the same microwave oven as in Example 1, at full power for four minutes. After cooking, the pastry is fully cooked, raised, and browned. Both ends of the package, where the susceptor material is present, have been forced open by the rising pastry and/or the generation of vapor thereby effectively venting the vapor generated from the cooking.

EXAMPLE 3

A vegetable-containing pastry is placed into a pouch as in Example 2. The pouch is sealed on three sides, leaving one end open. This pouch is placed inside a similar pouch, with the other end open. Upon cooking, the pastry cooks well. The presence of two pouches with openings at opposite ends provides a tortuous path for escape of steam. After cooking, the side seams have opened as far as the clear strip of film.

EXAMPLE 4

A package of commercial frozen french fries (Ore-Ida TM Golden Fries TM, from Ore-Ida Foods, Inc., Boise, Id. 83706) is opened and 225 g of fries are repackaged in a pouch 20 cm long and 15 cm wide, prepared as in Example 1. The pouch has clear seals 2.6 cm wide on both sides of the pouch and a 2.5 cm seal at one end. The fries are stacked 4 to 5 deep in the package. The remaining open end of the package is sealed, and the fries are cooked in a 700 watt Sharp Carousel II TM microwave oven. After two minutes, a 2 cm vent opens in an end seal, emitting steam. After 10 minutes cooking time the fries, although soggy and tough, are browned. Further optimization of the parameters of the package to give even better results are within the ability of one skilled in the art.

EXAMPLE 5

A frozen croissant ("L'Original", from Sara Lee, Deerfield, Ill. 60015) is repackaged in the same material as used in Example 4 and cooked in the same oven for 50 seconds. A vent about 1.3 cm in size opens in the center of the end seal. The resulting pastry is initially somewhat soggy upon removal from the oven, but dries in about 30 seconds to yield a good, slightly chewy but acceptable pastry.

COMPARATIVE EXAMPLE 5

An apple turnover as in Example 1 is sealed in a package in a similar fashion to Example 1. However, the film used to prepare the pouch is prepared from a strip of Sheet 1, described in Example 1, laminated (using Adcote TM adhesive) to a sheet of polyethylene terephthalate, 0.01 mm (0.48 mils) thick, metallized with aluminum to an optical density of 0.2. Vents in the package are provided by cutting two corners. In the microwave oven the metallized seal areas overheat and are destroyed within a few seconds. The pastry rises unconstrained by seals, and displaces the susceptor film from conforming contact. The pastry has a poor shape and is poorly browned.

EXAMPLE 6

Figure 10:
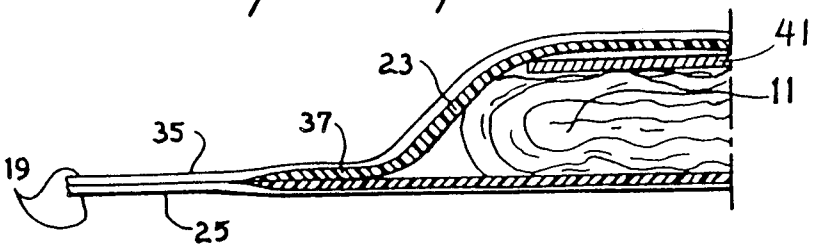

An apple turnover as in Example 1 is sealed in a package in a similar fashion to Example 1. However, a triangular piece of metallized film—paper board laminate, as described in U.S. Pat. No. 4,641,005, of approximately the same size as the turnover, is placed on the top side of the uncooked pastry, metallized side down between the pastry and the susceptor film comprising the pouch (41 in FIG. 10). In four minutes of microwave cooking an excellent, browned, well raised pastry results. The filling is somewhat moister than that of Example 1. It is believed that this improvement is due to the greater heating of the top surface of the turnover and the reduced transmission of microwave energy to the inside of the turnover, due to the presence of the metallized sheet. Metallization to an optical density of about 0.1 to about 0.3 is useful. It is also found that variations in filling formulation can yield equal results without the added sheet.

We claim:

1. A package useful for cooking food which expands upon cooking in a microwave oven, comprising;

(a) a thermally stable film wrapped about said food;

(b) at least one layer of heat releasable thermoplastic material located on at least a portion of the surface of said thermally stable film and forming a layered face-to-face seal from at least two surface areas of said thermally stable film, whereby the film is sealed in its wrapped conformation; and (c) a microwave susceptor material contained within at least a part of said seal and extending over at least that portion of the surface of the film which is wrapped about the food, said susceptor material having sufficient microwave absorbance to generate sufficient heat under microwave cooking conditions to brown or crispen the surface of the food and to raise the heat releasable thermoplastic material of the seal above its yield temperature, whereby said seal selectively opens in response to the expansion of said food, thereby maintaining contact between the surface of the food and the microwave susceptor material.

2. The package of claim 1 wherein the microwave susceptor material comprises a flake material.

3. The package of claim 2 wherein said flake material is embedded within at least one said layer of heat-releasable material.

4. The package of claim 3 wherein the flake material is aluminum flake.

5. The package of claim 4 further comprising a second sheet of microwave susceptor material positioned between said food and an adjacent layer of heat-releasable thermoplastic material containing said flake material.

6. The package of claim 4 wherein the thermally stable film is selected from the group consisting of polyesters, polyarylates, polycarbonates, polyimides, polyetherimides, semicrystalline polyamides, and polymethylpentene.

7. The package of claim 6 wherein the thermally stable film is a polyester selected from the group consisting of polyethylene terephthalate, polybutylene terephthalate, and copolyesters prepared from the condensation of terephthalic acid or 2,6-naphthalenedicarboxylic acid, with ethylene glycol, butylene glycol, or 1,4-cyclohexanedimethanol.

8. The package of claim 7 wherein the thermally s film is biaxially oriented polyethylene terephthalate film.

9. The package of claim 4 wherein the heat-releasable thermoplastic material is selected from the group consisting of polyester copolymers and ethylene copolymers.

10. The package of claim 9 wherein the layer of heat-releasable thermoplastic material is prepared from polymers selected from the group consisting of copolymers of ethylene glycol, terephthalic acid and azelaic acid; copolymers of ethylene glycol, terephthalic acid, and isophthalic acid; and mixtures of these copolymers.

11. The package of claim 10 wherein the layer of heat-releasable thermoplastic material is made of a copolymer prepared by the condensation of ethylene glycol with terephthalic acid and azelaic acid, said acids being in the mole ratio of about 50:50 to about 55:45.

12. The package of claim 4 wherein the heat-releasable thermoplastic material is a blend of polymers selected to provide a seal which releases at a predetermined temperature.

13. The package of claim 1 wherein said food generates pressure from vapor upon cooking, whereby said selectively heat-releasable seal selectively opens in response to the pressure of said vapor, thereby venting said vapor.

14. A process for preparing a package for cooking food which expands upon cooking in a microwave oven, comprising the steps of:

(a) selecting a conformable film having coated thereon at least one surface layer of a heat-releasable thermoplastic material and a microwave susceptive material in close proximity to said heat-releasable thermoplastic material and extending over at least that portion of the surface of the film which is destined to be in contact with the food, said susceptor material having sufficient microwave absorbance to generate sufficient heat under microwave cooking conditions to brown or crispen the surface of the food and to raise the heat releasable thermoplastic material above its yield temperature, said conformable film being of sufficient size to contain said food when said film is folded over on itself, (b) folding said conformable film over on itself to form two flaps, with the side of said film coated with the surface layer of heat-releasable thermoplastic material facing inward, (c) placing said food between said flaps, and (d) sealing the film around the remaining edges of said food to form at least one layered face-to-face seal in which said microwave susceptive material is in close contact with the heat-releasable thermoplastic material and is contained within the seal, whereby the food is securely enclosed within said film;

whereby said seal selectively opens in response to the expansion of said food during cooking, thereby maintaining contact between the surface of the food and the microwave susceptor material.

15. The process of claim 14 wherein the geometry of said selectively heat-releasable seal is adjusted to permit the food to expand in a controlled manner upon cooking.

16. A process for cooking foods in a microwave oven, comprising placing food contained in the package of claim 1 into a microwave oven and operating said oven for a time sufficient to cook said food.

17. The process of claim 16 wherein vents are placed in said package prior to cooking.

18. The process of claim 16 wherein said package is elevated above the floor of said microwave oven by about 25 mm to about 30 mm during cooking.

19. The package of claim 1 wherein the seal progressively peels opens from the inside outward in response to pressure generated under microwave cooking conditions from the food contained in said package.

* * * * *

UNITED STATES PATENT AND TRADEMARK OFFICE

CERTIFICATE OF CORRECTION

PATENT NO. : 4,911,938

DATED : March 27, 1990

INVENTOR(S) : John R. Fisher and Frederick E. Simon

It is certified that error appears in the above—identified patent and that said Letters Patent is hereby corrected as shown below:

Claim 8, column 11, line 58, the expression "thermally s" should read -- thermally stable --.

Signed and Sealed this

Fourteenth Day of May, 1991

*Attest:*

HARRY F. MANBECK, JR.

*Attesting Officer*

*Commissioner of Patents and Trademarks*